US007270614B2

(12) United States Patent
Watanabe et al.

(10) Patent No.: US 7,270,614 B2
(45) Date of Patent: Sep. 18, 2007

(54) MULTI-PIECE SOLID GOLF BALL

(75) Inventors: Hideo Watanabe, Chichibu (JP); Rinya Takesue, Chichibu (JP); Junji Hayashi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/349,182

(22) Filed: Feb. 8, 2006

(65) Prior Publication Data

US 2006/0128504 A1 Jun. 15, 2006

Related U.S. Application Data

(63) Continuation-in-part of application No. 10/765,088, filed on Jan. 28, 2004, now Pat. No. 7,086,967.

(51) Int. Cl.
*A63B 37/06* (2006.01)

(52) U.S. Cl. ..... 473/374

(58) Field of Classification Search ..... 473/373, 473/374, 368, 378

See application file for complete search history.

(56) References Cited

U.S. PATENT DOCUMENTS 5,306,760 A 4/1994 Sullivan
5,312,857 A 5/1994 Sullivan
5,830,085 A 11/1998 Higuchi et al.
5,935,022 A 8/1999 Sugimoto et al.
5,967,908 A 10/1999 Yamagishi et al.
6,213,896 B1 4/2001 Higuchi et al.
6,514,158 B1 2/2003 Nakamura et al.
6,558,275 B2 5/2003 Ohama
6,561,925 B2 5/2003 Watanabe et al.
2001/0016522 A1* 8/2001 Watanabe et al. ..... 473/371
2004/0198534 A1 10/2004 Sasaki
2006/0116221 A1* 6/2006 Watanabe et al. ..... 473/371

FOREIGN PATENT DOCUMENTS

JP 09-313643 A 12/1997
JP 10-305114 A 11/1998
WO WO98/46671 A1 10/1998

* cited by examiner

*Primary Examiner*—Raeann Trimiew
(74) *Attorney, Agent, or Firm*—Sughrue Mion Pllc.

(57) ABSTRACT

In the present invention, by optimizing the balance of Shore D hardness between the intermediate layer and the cover, the balance of Shore D hardness between the surface and the center in the core, the balance of initial velocity between the core and the sphere, and the balance of Deflection amount between the core and the sphere are optimized, and the total thickness of the intermediate layer and the cover, the inventive golf ball is given a good profile of rebound, feel, controllability and durability.

11 Claims, 1 Drawing Sheet

MULTI-PIECE SOLID GOLF BALL

CROSS-REFERENCE TO RELATED APPLICATION

This application is a continuation-in-part of application Ser. No. 10/765,088 filed on Jan. 28, 2004 now U.S. Pat. No. 7,086,967, the entire contents of which are hereby incorporated by reference.

BACKGROUND OF THE INVENTION

1. Technical Field

This invention relates to a multi-piece solid golf ball comprising a core and two or more covers enclosing the core which have a good profile of rebound, feel and controllability.

2. Prior Art

With the currently increasing population of golfers, the requirements on golf balls have been diversified and personalized. Golf balls have hitherto been modified and improved in a variety of ways to address such requirements of golfers.

For example, JP-A 9-313643 discloses a golf ball comprising a core, intermediate layer and cover which has optimized the hardness distribution of the core and the hardness distribution of the entire ball, thus simultaneously satisfying all requirements including excellent flight performance, durability, a good feel on impact and controllability. Also, JP-A 10-305114 describes a golf ball comprising a solid core, intermediate layer and cover, the cover having a plurality of dimples formed on a surface thereof, which has optimized the hardness balance among the core, intermediate layer and cover and the parameters of dimples, thereby improving the feel on impact and flight performance independent of head speed.

In addition, there has been proposed another type of multi-piece golf ball consisting of a core, an intermediate layer, and a cover, which is claimed to have good feel as well as improved flight performance owing to the adequate ratio between the deflection hardness of the core coated with the intermediate layer and the deflection hardness of the core alone according to JP-A 2001-218875. There has also been proposed another type of multi-piece golf ball consisting of a core, an intermediate layer, and a cover, in which the intermediate layer has a specific thickness and a specific hardness which are related with each other according to JP-A 2001-252374.

However, these golf balls are still insufficient in rebound. There is a need for golf balls that satisfy all properties of rebound, feel and controllability.

SUMMARY OF THE INVENTION

An object of the invention is to provide a golf ball having a good profile of rebound, feel, controllability and durability.

The invention pertains to a golf ball comprising a core, an intermediate layer enclosing the core to form a sphere, a cover enclosing the intermediate layer and numerous dimples formed on a surface of the cover. It has been found that when the balance of Shore D hardness between the intermediate layer and the cover, the balance of Shore D hardness between the surface and the center in the core, the balance of initial velocity between the core and the sphere, and the balance of Deflection amount between the core and the sphere are optimized, and the total thickness of the intermediate layer and the cover is properly selected, the golf ball is given a good profile of rebound, feel, controllability and durability. The present invention is predicated on this finding.

Accordingly, the present invention provides the following golf ball.

[1] A multi-piece solid golf ball comprising a core, an intermediate layer enclosing the core to form a sphere, and a cover enclosing the intermediate layer, and numerous dimples formed on a surface of the cover, wherein the each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (4), (11) & (12):

(1) (Shore D hardness of the cover)−(Shore D hardness of the intermediate layer)>0, (2A) (initial velocity of the core)−(initial velocity of the ball)≧0, (3) 0.87≦(Deflection amount of the sphere)/(Deflection amount of the core)≦0.97, (4) the total of the thickness of the intermediate layer and the thickness of the cover is up to 3.0 mm,

(11) (Deflection amount of the golf ball)/(Deflection amount of the sphere)≦0.98, and

(12) (Shore D hardness of core surface)−(Shore D hardness of core center)≧15.

[2] The multi-piece solid golf ball of above [1] wherein sulfur is compounded in an amount of 0.05 to 0.5 part by weight, and an organosulfur compound is compounded in an amount of 0.05 to 5 parts by weight, per 100 parts by weight of the base rubber, and the satisfies the following requirement.

1≦(amount of the organosulfur compound)/(amount of the sulfur)≦30.

[3] The multi-piece solid golf ball of above [1] wherein the total number of the dimples is at least 280 and not more than 360 and the ball has a coefficient of lift (CL) when hit of at least 0.165 at a Reynolds number of 70,000 and a spin rate of 2,000 rpm, and a coefficient of drag (CD) when hit of not more than 0.230 at a Reynolds number of 180,000 and a spin rate of 2,520 rpm.

[4] The multi-piece solid golf ball of above [1] which further satisfies the following requirements (5) to (9):

(5) the thickness of the cover is from 0.5 mm to 2.0 mm, (6) the Shore D hardness of the cover is from 52 to 62, (7) the thickness of the intermediate layer is from 0.5 mm to 1.6 mm, (8) the Shore D hardness of the intermediate layer is from 40 to 60, and (9) the golf ball has an initial velocity of at least 76.5 m/s.

[5] The multi-piece solid golf ball of above [1] which further satisfies the following requirements (10):

(10) the cover has a melt flow rate (MFR) of at least 2 g/10 min.

[6] The multi-piece solid golf ball of above [1] wherein the value as described in the requirement (11) is at least 0.85 and not more than 0.95.

[7] The golf ball of above [1] wherein said intermediate layer comprises (A) an ionomer resin comprising (a-1) an olefin/unsaturated carboxylic acid binary random copolymer and/or a metal ion-neutralized product thereof and (a-2) an olefin/unsaturated carboxylic acid/unsaturated carboxylic acid ester ternary random copolymer and/or a metal ion neutralized product thereof in a weight ratio (a-1)/(a-2) between 100/0 and 0/100, and (B) a non-ionomeric thermoplastic elastomer in a weight ratio A/B between 100/0 and 50/50.

[8] The golf ball of above [7] wherein said intermediate layer is made of a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in said resin component and component (C).

BRIEF DESCRIPTION OF THE DIAGRAMS

DESCRIPTION OF THE PREFERRED EMBODIMENTS

Figure 1:
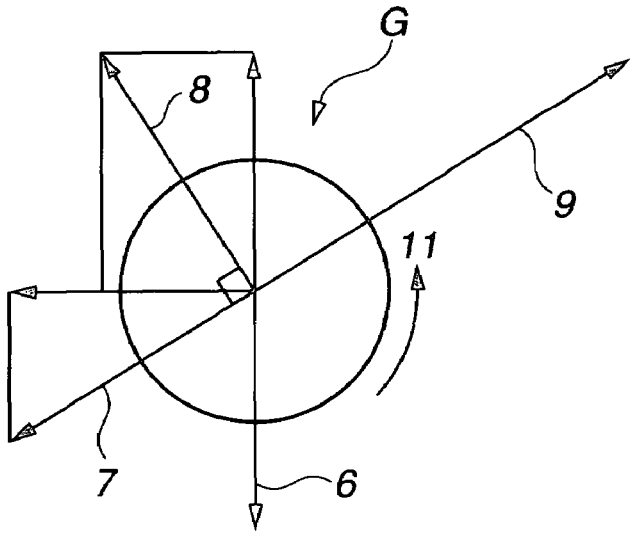
FIG. 1 is a diagram illustrating the relationship between lift and drag on a golf ball in flight.

The multi-piece solid golf ball of the invention comprises a core, an intermediate layer enclosing the core to form a sphere, and a cover enclosing the intermediate layer, and numerous dimples formed on a surface of the cover.

The ball satisfies the following requirements (1) to (4), (11) & (12):

(1) (Shore D hardness of the cover)−(Shore D hardness of the intermediate layer)>0, (2A) (initial velocity of the core)−(initial velocity of the ball)≧0

(3) 0.87≦(Deflection amount of the sphere)/(Deflection amount of the core)≦0.97, (4) the total of the thickness of the intermediate layer and the thickness of the cover is up to 3.0 mm,

(11) (Deflection amount of the golf ball)/(Deflection amount of the sphere)≦0.98, and

(12) (Shore D hardness of core surface)−(Shore D hardness of core center)≧15.

As used herein, the term "sphere" means the core enclosed with the intermediate layer unless otherwise stated.

As used herein, the "Deflection amount" is defined as the amount of deflection or deformation (in mm) under load of a spherical body incurred when the load is increased from an initial value of 98 N (10 kgf) to a final value of 1275 N (130 kgf). The term "spherical body" is used to include the core, the sphere and the ball.

Intermediate Layer and Cover

The intermediate layer and/or the cover is preferably formed of a material which comprises (A) an ionomer resin comprising (a-1) an olefin/unsaturated carboxylic acid binary random copolymer and/or a metal ion neutralized olefin/unsaturated carboxylic acid binary random copolymer and (a-2) an olefin/unsaturated carboxylic acid/unsaturated carboxylic acid ester ternary random copolymer and/or a metal ion neutralized olefin/unsaturated carboxylic acid/unsaturated carboxylic acid ester ternary random copolymer in a weight ratio (a-1)/(a-2) between 100/0 and 0/100, and (B) a non-ionomeric thermoplastic elastomer in a weight ratio A/B between 100/0 and 50/50; and more preferably a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in the resin component and component (C).

The olefins in components (a-1) and (a-2) have a number of carbon atoms that is generally at least 2, but not more than 8, and preferably not more than 6. Specific examples of olefins include ethylene, propylene, butene, pentene, hexene, heptene and octene. Ethylene is especially preferred.

Suitable examples of the unsaturated carboxylic acid include acrylic acid, methacrylic acid, maleic acid and fumaric acid. Acrylic acid and methacrylic acid are especially preferred.

The unsaturated carboxylic acid esters in component (a-2) include lower alkyl esters of the foregoing unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, isobutyl acrylate) is especially preferred.

The olefin/unsaturated carboxylic acid binary random copolymer of component (a-1) and the olefin/unsaturated carboxylic acid/unsaturated carboxylic acid ester ternary random copolymer of component (a-2) (the copolymers are collectively referred to as "random copolymers," hereinafter) can each be obtained by suitably formulating the above-described olefin, unsaturated carboxylic acid and optional unsaturated carboxylic acid ester and carrying out random copolymerization in a conventional manner.

It is recommended that the random copolymers be prepared such as to have a specific unsaturated carboxylic acid content (sometimes referred to as the "acid content," hereinafter). The amount of unsaturated carboxylic acid included within the random copolymer of component (a-1) is at least 4 wt %, preferably at least 6 wt %, more preferably at least 8 wt %, and most preferably at least 10 wt %, but not more than 30 wt %, preferably not more than 20 wt %, more preferably not more than 18 wt %, and most preferably not more than 15 wt %. Similarly, the amount of unsaturated carboxylic acid included within the random copolymer of component (a-2) is at least 4 wt %, preferably at least 6 wt %, and more preferably at least 8 wt %, but not more than 15 wt %, preferably not more than 12 wt %, and more preferably not more than 10 wt %. If the random copolymer of component (a-1) and/or (a-2) has too low an acid content, resilience may decline. Too high an acid content may lower processability.

The metal ion neutralized product of an olefin/unsaturated carboxylic acid binary random copolymer in component (a-1) and the metal ion neutralized product of an olefin/unsaturated carboxylic acid/unsaturated carboxylic acid ester ternary random copolymer in component (a-2) (the metal ion neutralized products of such copolymers are collectively referred to as "metal ion-neutralized random copolymers," hereinafter) can each be obtained by neutralizing some or all of the acid groups on the random copolymer with metal ions.

Illustrative examples of metal ions for neutralizing the acid groups on the random copolymer include $Na^+$, $K^+$, $Li^+$, $Zn^{2+}$, $Cu^{2+}$, $Mg^{2+}$, $Ca^{2+}$, $Co^{2+}$, $Ni^{2+}$ and $Pb^{2+}$. Preferred metal ions are $Na^+$, $Li^+$, $Zn^{2+}$ and $Mg^{2+}$. The use of $Na^+$ is especially recommended for improved resilience.

The metal ion-neutralized random copolymers may be prepared by neutralization with such metal ions. For example, formates, acetates, nitrates, carbonates, bicarbonates, oxides, hydroxides or alkoxides of the above metal ions are added to the acid group-bearing random copolymers to neutralize acid groups. The degree of neutralization of the random copolymer with metal ions is not particularly limited.

Commercial products may be used as components (a-1) and (a-2). Exemplary commercial products that may be used as the random copolymer in component (a-1) include Nucrel 1560, Nucrel 1214 and Nucrel 1035 (Du Pont-Mitsui Polychemicals Co., Ltd.), and Escor 5200, Escor 5100 and Escor 5000 (ExxonMobil Chemical Company).

Exemplary commercial products that may be used as the metal ion-neutralized random copolymer in component (a-1) include Himilan 1554, Himilan 1557, Himilan 1601, Himilan 1605, Himilan 1706 and Himilan AM7311 (Du Pont-Mitsui Polychemicals Co., Ltd.), Surlyn 7930 (E.I. du Pont de Nemours & Co., Inc.) and Iotek 3110 and Iotek 4200 (ExxonMobil Chemical Company).

Exemplary commercial products that may be used as the random copolymer in component (a-2) include Nucrel AN4311 and Nucrel AN4318 (Du Pont-Mitsui Polychemicals Co., Ltd.), and Escor ATX325, Escor ATX320 and Escor ATX310 (ExxonMobil Chemical Company).

Exemplary commercial products that may be used as the metal ion-neutralized random copolymer in component (a-2) include Himilan 1855, Himilan 1856 and Himilan AM7316 (Du Pont-Mitsui Polychemicals Co., Ltd.), Surlyn 6320, Surlyn 8320, Surlyn 9320 and Surlyn 8120 (E.I. du Pont de Nemours & Co., Inc.), and Iotek 7510 and Iotek 7520 (ExxonMobil Chemical Company).

The random copolymers and metal ion-neutralized random copolymers may be used alone or in admixture of any as each component (a-1) or (a-2). Examples of sodium-neutralized ionomer resins which are preferred as the metal ion-neutralized random copolymers include Himilan 1605, Himilan 1601 and Surlyn 8120.

Component (a-2) accounts for greater than or equal to 0 wt % (% by weight), preferably greater than or equal to 50 wt % of the total weight of components (a-1) and (a-2) while the upper limit of component (a-2) content is generally less than or equal to 100 wt %.

Component (B) is a non-ionomeric thermoplastic elastomer which is preferably included to further enhance both the feel of the golf ball upon impact and its rebound characteristics. In this disclosure, the ionomer resin (A) and non-ionomeric thermoplastic elastomer (B) are collectively referred to as the "resin component."

Specific examples of the non-ionomeric thermoplastic elastomer (B) include olefinic elastomers, styrenic elastomers, polyester elastomers, urethane elastomers and polyamide elastomers. Of these, olefinic elastomers and polyester elastomers are preferred for further increasing resilience.

Commercial products may be used as component (B). An exemplary olefinic elastomer is Dynaron (JSR Corporation) and an exemplary polyester elastomer is Hytrel (Du Pont-Toray Co., Ltd.). They may be used alone or in admixture.

Component (B) generally accounts for greater than or equal to 0 wt %, preferably greater than or equal to 15 wt % based on the total weight of the resin component while the upper limit of component (B) content is generally less than or equal to 50 wt %, preferably less than or equal to 40 wt %. If the content of component (B) in the resin component is more than 50 wt %, the respective components may become less compatible, resulting in golf balls with a drastic decline of durability.

Component (C) is an organic fatty acid and/or fatty acid derivative having a molecular weight of 280 to 1,500. This component is advantageously included because its molecular weight is very low compared to the resin component and it is effective to adjust the melt viscosity of the mixture to a suitable level, particularly to help improve flow.

The molecular weight of the organic fatty acid or fatty acid derivative (C) is at least 280, preferably at least 300, more preferably at least 330, and most preferably at least 360, but not more than 1,500, preferably not more than 1,000, more preferably not more than 600, and most preferably not more than 500. Too low a molecular weight may lead to poor heat resistance whereas too high a molecular weight may fail to improve flow.

Preferred examples of the organic fatty acid (C) include unsaturated organic fatty acids having a double bond or triple bond on the alkyl group, and saturated organic fatty acids in which all the bonds on the alkyl group are single bonds. It is recommended that the number of carbons on the organic fatty acid molecule be at least 18, preferably at least 20, more preferably at least 22, and most preferably at least 24, but up to 80, preferably up to 60, more preferably up to 40, and most preferably up to 30. Too few carbons may lead to poor heat resistance and may also make the content of acid groups relatively high so as to diminish the flow-enhancing effect on account of excessive interactions with acid groups in the resin component. On the other hand, too many carbons increases the molecular weight, which may prevent the significant flow-enhancing effect from being achieved.

Specific examples of organic fatty acids that may be used as component (C) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Organic fatty acid derivatives which may be used as component (C) include metallic soaps in which the proton on the acid group of the above organic fatty acid is substituted with a metal ion. Metal ions that may be used in such metallic soaps include $Na^+$, $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are preferred.

Specific examples of organic fatty acid derivatives that may be used as component (C) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred. They may be used alone or in admixture of any.

The amount of component (C) included is at least 5 parts by weight (pbw), preferably at least 10 pbw, more preferably at least 15 pbw, and most preferably at least 18 pbw, per 100 pbw of the resin component (i.e., A+B). The upper limit of component (C) amount is up to 80 pbw, preferably up to 40 pbw, more preferably up to 25 pbw, and most preferably up to 22 pbw per 100 pbw of the resin component. Too small an amount of component (C) included may lead to a very low melt viscosity and hence, poor processability whereas too large an amount of component (C) may adversely affect durability.

It is noted that known metallic soap-modified ionomers, including those described in U.S. Pat. Nos. 5,312,857, 5,306,760 and International Application WO 98/46671, may be used as the combination of ionomer resin (A) with component (C).

Component (D) is a basic inorganic metal compound which can neutralize un-neutralized acid groups in the resin component and component (C). If a metallic soap-modified ionomer resin is used alone without including component (D), for example, the metallic soap and the un-neutralized acid groups present on the ionomer resin undergo exchange reactions during heat mixing, generating a large amount of fatty acid which will readily vaporize. The fatty acid thus generated can cause problems to molded parts, for example, molded parts having defects, poor adhesion of paint film, and low rebound. To avoid such problems, component (D) is advantageously included.

Preferred component (D) is a basic inorganic metal compound which is highly reactive with the resin component and forms reaction by-products devoid of organic acids.

Illustrative examples of the metal ions in the basic inorganic metal compound (D) include $Li^+$, $Na^+$, $K^+$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$, $Sn^{2+}$, $Pb^{2+}$ and $Co^{2+}$. These metal ions may be used alone or in admixture of any. Known basic inorganic fillers containing these metal ions may be used as the basic inorganic metal compound (D). Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. Inter alia, hydroxides and monoxides are recommended. Calcium hydroxide and magnesium oxide are especially preferred because they have a high reactivity with the resin component.

The amount of basic inorganic metal compound (D) included is at least 0.1 part by weight (pbw), preferably at least 0.5 pbw, more preferably at least 1 pbw, and most preferably at least 2 pbw, per 100 pbw of the resin component (i.e., A+B). As to the upper limit, the amount of component (D) is up to 10 pbw, preferably up to 8 pbw, more preferably up to 6 pbw, and most preferably up to 5 pbw per 100 pbw of the resin component. Too small an amount of component (D) included may fail to achieve improvements in thermal stability and resilience whereas too large an amount of component (D) may rather adversely affect the heat resistance of a golf ball material.

It is recommended that the mixture formulated by combining components (A) to (D) have a degree of neutralization which is at least 50 mol %, preferably at least 60 mol %, more preferably at least 70 mol %, and most preferably at least 80 mol %, based on the entire amount of acid groups in the mixture. The mixture with such a high degree of neutralization offers the advantage that even on use of a metal soap-modified ionomer resin, for example, the exchange reactions between the metal soap and un-neutralized acid groups in the ionomer resin during heat mixing are retarded, thus minimizing the risk of compromising the thermal stability, moldability and resilience of the mixture.

In addition to the aforementioned components (A) to (D), the material of which the intermediate layer and/or the cover is made in the practice of the invention may further include such additives as pigments, dispersants, antioxidants, ultraviolet absorbers and light stabilizers. Such additives may be incorporated in any desired amounts. The amount of additive is typically at least 0.1 pbw, preferably at least 0.5 pbw, more preferably at least 1 pbw per 100 pbw of the resin component (i.e., A+B). As to the upper limit, the amount of additive is typically up to 10 pbw, preferably up to 6 pbw, more preferably up to 4 pbw per 100 pbw of the resin component.

The material for the intermediate layer and/or the cover can be prepared by combining the essential and optional components described above, heating and mixing them together. For example, they are mixed on an internal mixer such as a kneading-type twin-screw extruder, a Banbury mixer or a kneader while heating at a temperature of 150 to 250° C.

Core

The core in the inventive golf ball may be either a thread-wound core or a solid core and may be produced by a conventional method. The core may be formed from a base rubber as a primary material.

For example, a solid core can be produced from a rubber composition comprising 100 parts by weight of cis-1,4-polybutadiene; from 10 to 60 parts by weight of one or more crosslinking agents selected from among α,β-monoethylenically unsaturated carboxylic acids (e.g., acrylic acid, methacrylic acid) or metal ion-neutralized compounds thereof and functional monomers (e.g., trimethylolpropane methacrylate); from 5 to 30 parts by weight of a filler such as zinc oxide or barium sulfate; from 0.5 to 5 parts by weight of a peroxide such as dicumyl peroxide; and, if necessary, from 0 to 1 part by weight of an antioxidant. The rubber composition may be formed into a solid spherical core by press vulcanization to effect crosslinkage, followed by compression under heating at 140 to 170° C. for a period of 10 to 40 minutes.

It is preferable that a rubber composition being a base rubber comprises sulfur cores. Examples of the sulfur used in the present invention include sulfur powder and specifically is "Z Sulfur" by Tsurumi Chemical Industry Corporation.

The amount of the sulfur is more than 0.05 part by weight, preferably more than 0.07 part by weight, further preferably more than 0.09 part by weight, and as a upper limit, not more than 0.5 part by weight, preferably not more than 0.3 part by weight, further preferably not more than 0.2 part by weight. Too low amount of sulfur makes it impossible that the difference between the core surface and the core center. On the other hand, too much amount of sulfur may bring the lower rebound characteristics of the core. As a result, the flight performance may be insufficient.

In view of enhance of rebound characteristics of the golf ball, it is preferable that the organosulfur compound is included in the base rubber being the primary material of the core. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, and zinc salts thereof, such as the zinc salt of pentachlorothiophenol; and organosulfur compounds having 2 to 4 sulfurs, such as diphenylpolysulfides, dibenzylpolysulfides, dibenzoylpolysulfides, dibenzothiazoylpolysulfides and dithiobenzoylpolysulfides. Diphenyldisulfide and the zinc salt of pentachlorothiophenol are especially preferred.

The organosulfur compound is included in an amount, per 100 parts by weight of the base rubber, of preferably at least 0.05 part by weight, more preferably at least 0.1 part by weight. Too little organosulfur compound makes it impossible to desire the improvement of the rebound characteristics. Also, the amount of the organosulfur compound is preferably not more than 5 parts by weight, further preferably not more than 4 parts by weight, most preferably not more than 2 parts by weight. Too much organosulfur compound results in an excessively soft of the core and poor feel upon impact and is less durable to cracking upon repeated impact.

Here, it is desirable that the amount ratio of the between above-described sulfur and organosulfur compound satisfies the following requirement.

1≦(amount of the organosulfur compound)/(amount of the sulfur)≦30.

The value of the above-described (amount of the organosulfur compound)/(amount of the sulfur) is further preferably more than 3 parts by weight, most preferably 5 parts by weights, and as a upper limit, further preferably not more than 25 parts by weight, most preferably not more than 20 part by weight. Too little value may bring the lower rebound characteristics of the core. As a result, the flight performance may be insufficient. Reversely, too much value may result in an excessively soft of the ball hardness and insufficient hardness difference between the core surface and the core center, more spin. As a result, the flight performance may be insufficient.

The core has a Deflection amount of preferably at least 2.5 mm, more preferably at least 3.0 mm, and most preferably at least 3.3 mm. As to the upper limit, Deflection amount of the core is up to 5.5 mm, preferably up to 4.5 mm, and more preferably up to 4.0 mm. A core with a Deflection amount of less than 2.5 mm may cause the golf ball to receive more spin and thus travel a shorter distance and to give a hard feel upon impact. On the other hand, a core with a Deflection amount of more than 5.5 mm may be less resilient so that the ball may have a shorter distance of travel and too soft a feel and be less durable to cracking upon repeated impact.

It is recommended that the solid core have a diameter of at least 36.8 mm, preferably at least 37.2 mm, further preferably at least 37.6 mm, and but usually not more than 41.8 mm, preferably not more than 40.8 mm, and further preferably not more than 38.8 mm.

Also the core has a specific gravity of at least 1.05 g/cm$^3$, preferably at least 1.15 g/cm$^3$. As to the upper limit, the core usually has a specific gravity of up to 1.35 g/cm$^3$, preferably up to 1.25 g/cm$^3$.

Regarding core surface hardness, the core has a Shore D hardness of at least 45, preferably at least 50, and more preferably at least 53. As to the upper limit, the core usually has a Shore D hardness of up to 65, preferably up to 62, and more preferably up to 60. If the Shore D hardness on the core surface is more than 65, the feel on impact of the ball may become hard. If the Shore D hardness on the core surface is less than 45, the ball may have low rebound, a shorter flight, too soft a feel on impact, and poor durability to cracking upon repeated impact. Desirably, the intermediate layer is softer than the core surface. If the intermediate layer is harder than the core surface, the feel may be poor.

Regarding core center hardness, the core has a Shore D hardness of at least 30, preferably at least 33, and more preferably at least 35. As to the upper limit, the core usually has a Shore D hardness of up to 50, preferably up to 45, and more preferably up to 40. If the Shore D hardness on the core center is less than 30, the ball may be less resilient so that the ball may have a shorter distance of travel and too soft a feel and be less durable to cracking upon repeated impact. If the Shore D hardness on the core center is more than 50, the golf ball may receive more spin and thus travel a shorter distance and to give a hard feel upon impact.

While it is recommended that the core, the intermediate layer and the cover of the inventive multi-piece solid golf ball be formed of the above-described materials, respectively, the invention intends to provide a golf ball having a good profile of rebound, feel and controllability and durability by optimizing the balance of Shore D hardness between the intermediate layer and the cover as specified by requirement (1), the balance of initial velocity between the core and the ball as specified by requirement (2A), the balance of Deflection amount between the core and the sphere as specified by requirement (3) and the total of the thickness (in mm) of both of the intermediate layer and the cover as specified by requirement (4), further, the balance of Deflection amount between the ball and the sphere as specified by requirement (11) and the balance of Shore D hardness between the surface and the center in the core as specified by requirement (12), which are as follows.

(1) (Shore D hardness of the cover)−(Shore D hardness of the intermediate layer)>0, (2A) (initial velocity of the core)−(initial velocity of the ball)≧0

(3) 0.87≦(Deflection amount of the sphere)/(Deflection amount of the core)≦0.97, (4) the total of the thickness of the intermediate layer and the thickness of the cover is up to 3.0 mm, And, further, the inventive multi-piece solid golf ball satisfy the following requirements (11) & (12).

(11) (Deflection amount of the golf ball)/(Deflection amount of the sphere)≦0.98, and

(12) (Shore D hardness of core surface)−(Shore D hardness of core center)≧15.

Also, in order to enhance the advantages, the golf ball should desirably satisfy the following requirements (5) to (10).

(5) The thickness (in mm) of the cover is from 0.5 mm to 2.0 mm.

(6) The Shore D hardness of the cover is from 55 to 70.

(7) The thickness (in mm) of the intermediate layer is from 0.5 mm to 1.6 mm.

(8) The Shore D hardness of the intermediate layer is from 40 to 60.

(9) The golf ball has an initial velocity of at least 76.5 m/s.

(10) The cover has a melt flow rate (MFR) of at least 2 g/10 min.

Regarding Requirement (1):

In the inventive golf ball, the difference of the Shore D hardness of the cover minus the Shore D hardness of the intermediate layer is more than 0, preferably at least 5, and more preferably at least 10, but up to 30, preferably up to 20, and more preferably up to 15. If the difference is 0 or negative, the flight distance becomes short due to more spin receptivity. If the difference is more than 30, the flight distance may become short due to less rebound.

Regarding Requirement (2A):

In the inventive golf ball, the difference of the initial velocity (in m/s) of the core minus the initial velocity (in m/s) of the ball is more than 0, preferably at least 0.2, more preferably at least 0.4. If the difference is 0 or negative, the ball having good rebound, controllability and feel may not be produced. The effective means for meeting requirement (2A) is to form the intermediate layer from a highly resilient material. Making the intermediate layer harder and the core softer and less resilient is likely to meet requirement (2A), but this means alone fails to achieve the advantages of the invention unless the remaining requirements are met at the same time.

It is noted that the "initial velocity" (in m/s) is measured using the same type of initial velocity instrument as the drum rotation instrument approved by the United States Golf-Association (USGA). The balls were conditioned in an environment of 23±1° C. for more than 3 hours before they were tested in a room at a temperature of 23±2° C. Using a club with a head having a striking mass of 250 pounds (113.4 kg), the balls were hit at a head speed of 143.8 ft/s (43.83 m/s). A dozen of balls were hit each four times while the time for passage over a distance of 6.28 feet (1.91 m) was measured, from which the initial velocity (m/s) was computed. This cycle was completed within about 15 minutes.

Regarding Requirement (3):

In the inventive golf ball, the ratio of the Deflection amount of the sphere to the Deflection amount of the core is at least 0.87, preferably at least 0.88, and more preferably at least 0.90. As to the upper limit, the ratio is up to 0.97, preferably up to 0.96, and more preferably up to 0.95. A Deflection amount ratio of less than 0.87 leads to a hard feel when hit with a putter, and more spin and a resultant shorter travel distance when hit with a driver (W#1). A ratio of more than 0.97 leads to more spin and a resultant shorter travel distance when hit with a driver (W#1), and low durability against repeated impact.

The effective means for designing the golf ball so as to meet requirement (3) is to provide the intermediate layer with a Shore D hardness in a range of about 40 to about 60 and set the thickness of the intermediate layer and the hardness of the core in appropriate ranges.

Regarding Requirement (4):

In the inventive golf ball, the total of the thickness (in mm) of the intermediate layer and the thickness (in mm) of the cover is up to 3.0 mm, preferably up to 2.8 mm, and more preferably up to 2.6 mm. As to the lower limit, the total thickness is preferably at least 0.5 mm, more preferably at least 1.0 mm, even more preferably at least 2.0 mm. A total thickness of more than 3.0 mm leads to more spin and a resultant shorter travel distance when hit with a driver (W#1). A total thickness of less than 0.5 mm may lead to low durability against repeated impact.

Regarding Requirement (5):

In the inventive golf ball, the thickness (in mm) of the cover is at least 0.5 mm, preferably at least 0.9 mm, and more preferably at least 1.1 mm. As to the upper limit, the cover thickness is up to 2.0 mm, preferably up to 1.6 mm, and more preferably up to 1.3 mm. A cover thickness of less than 0.5 mm may lead to low durability against repeated impact. A cover thickness of more than 2.0 mm may worsen the feel on approach and putter shots.

Regarding Requirement (6):

In the inventive golf ball, the Shore D hardness of the cover is at least 52, preferably at least 55, and more preferably at least 57. As to the upper limit, the cover Shore D hardness is up to 62, preferably up to 61, and more preferably up to 60. A cover Shore D hardness of less than 52 may lead to a shortage of travel distance due to more spin or poor rebound, and poor scuff resistance. A cover Shore D hardness of more than 62 may lead to poor durability to cracking upon repeated impact and worsen the feel on impact in what the golfers refer to as "short game" and on putter shots and poor in approach controllability.

Regarding Requirement (7):

In the inventive golf ball, the thickness (in mm) of the intermediate layer is at least 0.5 mm, preferably at least 0.8 mm, and more preferably at least 1.1 mm. As to the upper limit, the intermediate layer thickness is up to 1.6 mm, preferably up to 1.4 mm, and more preferably up to 1.3 mm. An intermediate layer thickness of less than 0.5 mm may lead to low durability to cracking upon repeated impact and a shorter travel distance due to low rebound. An intermediate layer thickness of more than 1.6 mm may lead to more spin and a resultant shorter travel distance when hit with a driver (W#1).

Regarding Requirement (8):

In the inventive golf ball, the Shore D hardness of the intermediate layer, which means sheet hardness of the material constructing intermediate layer, is at least 40, preferably at least 45, and more preferably at least 48. As to the upper limit, the intermediate layer Shore D hardness is up to 60, preferably up to 55, and more preferably up to 52. An intermediate layer Shore D hardness of less than 40 may lead to a shortage of travel distance due to more spin or poor rebound. An intermediate layer Shore D hardness of more than 60 may lead to poor durability to cracking upon repeated impact and worsen the feel on short-game and putter shots.

Regarding Requirement (9):

The inventive golf ball has an initial velocity of at least 76.5 m/s, preferably at least 76.8 m/s, and more preferably at least 77.1 m/s. As to the upper limit, the initial velocity is up to 77.724 m/s. With too low an initial velocity, the flight distance may become shorter. Beyond the upper limit of 77.724 m/s, which is outside the standard of the USGA, the balls cannot be registered as being authorized.

Regarding Requirement (10):

In the inventive golf ball, the cover material has a melt flow rate (MFR) of at least 2.0 g/10 min, preferably at least 2.2 g/10 min, and more preferably at least 2.6 g/10 min. A material with an MFR of less than 2 g/10 min may be difficult to mold or be molded into balls which have poor sphericity and vary in flight performance. As used herein, the melt flow rate (MFR) is measured according to JIS K6760 at a temperature of 190° C. and a load of 21.18 N (2.16 kgf).

Regarding Requirement (11):

In the inventive golf ball, the ratio of the Deflection amount of the golf ball to the Deflection amount of the sphere is preferably at least 0.85, and more preferably at least 0.88. At to the upper limit, the Deflection amount ratio is up to 0.98, preferably up to 0.95, and more preferably up to 0.92. With too low or too high a ratio, the ball when hit with a driver (W#1) may receive more spin and thus travel a less distance.

The effective means for designing the golf ball so as to meet requirement (11) is to set the hardness and thickness of the cover and the Deflection amount of the sphere in appropriate ranges.

Regarding Requirement (12):

In the inventive golf ball, the difference of the Shore D hardness of the core surface minus the Shore D hardness of core center is more than 15, preferably at least 16, and more preferably at least 17, but up to 30, preferably up to 25, more preferably up to 23. Too small Shore D difference may bring more spin, resulting in the insufficient flight distance. Reversely, too large Shore D difference may be less durable to cracking upon repeated impact and the initial velocity may lower when hit with a driver (W#1), which travel a less distance.

Also, the golf ball thus obtained can have numerous dimples formed on the surface of the cover thereof by a conventional method. After dimple formation, finishing operations such as buffing, painting and stamping can be carried out on the surface of the ball.

The meaning here of "numerous dimples" is described more fully.

The total number of dimples is at least 280, preferably at least 300, and more preferably at least 320, but not more than 360, preferably not more than 350, and even more preferably not more than 340. If the number of dimples is greater than the above range, the ball will have a low trajectory, shortening the distance of travel. On the other hand, if the number of dimples is smaller that the above range, the trajectory of the ball becomes so high as to prevent the ball from traveling a longer distance. It is recommended that the number of dimple types be at least three, and preferably at least five, but not more than 30, and preferably not more than 20. The shape of the dimples is not subject to any particular limitation, and may be of a circular shape, any of various polygonal shapes, a dew drop shape, or an elliptical shape. Any one or combination of two or more of these shapes may be suitably used. For example, if the dimples are circular, dimples having a diameter of about 2.5 to 6.5 mm and a depth of 0.08 to 0.30 mm can be used. It is preferable for the value $V_0$ for each dimple, defined as the volume of space in the dimple below a flat plane circumscribed by the edge of the dimple divided by the volume of a cylinder whose base is the flat plane and whose height is the maximum depth of the dimple from the base, to be in a range of 0.35 to 0.80.

The dimples may be suitably selected in such a way that the proportion of the total surface area of an imaginary sphere accounted for by the combined surface area of dimple regions circumscribed by the edges of the individual dimples, sometimes referred to as the dimple surface coverage (SR) and expressed in percent, is within a range of 60 to 90%. The dimples may also be suitably selected in such a way that the proportion of the volume of an imaginary golf ball that is free of dimples accounted for by the combined volume of the dimples on the surface of the golf ball, sometimes referred to as the dimple volume occupancy (VR) and expressed in percent, is in a range of 0.6 to 1%. If the VR and SR values are outside of the above ranges, it may difficult to obtain a suitable trajectory and the carry of the ball may decrease.

Moreover, to improve the carry of the ball, it is desirable for the ball to have a low coefficient of drag under high velocity conditions and a high coefficient of lift under low velocity conditions.

When a golf ball is hit with a club such as a driver (number one wood, W#1) for distance, a proper balance of lift and drag is desirable for achieving a good carry, particularly against a headwind, and for a good run after the ball lands on the ground. Such a balance depends on the ball construction, on the materials used in the ball, and also, in particular, on such dimple attributes as the types of dimples, total number of dimples, and the surface coverage and total volume of the dimples.

As shown in FIG. 1, a golf ball G in flight that has been hit by a club is known to incur gravity 6, air resistance (drag) 7, and also lift 8 due to the Magnus effect because the ball has spin. Also indicated in the same diagram are the direction of flight 9 and the direction 11 in which the ball G is spinning.

The forces acting upon the golf ball in this case are represented by the following trajectory equation (1).

$$F=FL+FD+Mg \quad (1)$$

where F: forces acting upon golf ball

FL: lift

FD: drag

Mg: gravity

The lift FL and drag FD in the trajectory equation (1) are given by formulas (2) and (3) below.

$$FL=0.5\times CL\times\rho\times A\times V2 \quad (2)$$

$$FD=0.5\times CD\times\rho\times A\times V2 \quad (3)$$

where CL: coefficient of lift

CD: coefficient of drag

ρ: air density

A: maximum cross-sectional surface area of golf ball

V: air velocity with respect to golf ball

Decreasing the drag or the coefficient of drag CD by itself is not very effective for improving the carry of the ball. Making only the drag coefficient small will extend the position of the ball at the highest point of its trajectory, but in the low-velocity region after the highest point, the ball will drop due to insufficient lift and thus tend to lose carry.

The golf ball of the invention has a low-velocity CL, which is the coefficient of lift from the ball's trajectory just after being launched with an Ultra Ball Launcher (UBL) when measured at a Reynolds number of 70,000 and a spin rate of 2,000 rpm, of at least 0.165, preferably at least 0.170, and more preferably at least 0.180. The inventive golf ball has a high-velocity CD, which is the coefficient of drag just after launch at a Reynolds number of 180,000 and a spin rate of 2,520 rpm, of not more than 0.230, preferably not more than 0.225, and more preferably not more than 0.220. Outside of these ranges, the golf ball cannot achieve a good carry. The UBL is a device which includes two pairs of drums, one on top and one on the bottom. The drums are turned by belts across the two top drums and across the two bottom drums. The UBL inserts a golf ball between the turning drums and launches the golf ball under the desired conditions. This device is manufactured by Automated Design Corporation. A Reynolds number of 180,000 just after the ball is launched corresponds to a ball velocity of about 66 m/s, and a Reynolds number of 70,000 corresponds to a ball velocity of about 26 m/s.

The golf ball of the invention may be manufactured for use in tournaments by giving it a diameter and weight which conform with the Rules of Golf. That is, the ball may be produced to a diameter of not less than 42.67 mm and a weight of not greater than 45.93 g. As the upper limit of diameter, the ball diameter is preferably up to 44.0 mm, more preferably up to 43.5 mm, and most preferably up to 43.0 mm. As the lower limit of weight, the ball weight is preferably at least 44.5 g, more preferably at least 45.0 g, even more preferably at least 45.1 g, and most preferably at least 45.2 g.

EXAMPLE

Examples of the invention and comparative examples are given below by way of illustration, and are not intended to limit the invention.

Examples 1-3 and Comparative Examples 1-5

Three-piece solid golf balls were manufactured. First the cores were produced by molding rubber compositions whose formulation is shown in Table 1 and vulcanizing at 157° C. for 15 minutes. Over the cores, intermediate layer materials and cover materials whose formulations are shown in Table 2 were injection molded in sequence. A plurality of dimples were formed on the cover of each three-piece solid golf balls. The dimple is shown in Table 4 and Table 5.

The test results of the golf balls are shown in Table 3.

TABLE 1

| | Core composition (pbw) | | | | | | | |
|---|---|---|---|---|---|---|---|---|
| | Example | | | Comparative Example | | | | |
| | 1 | 2 | 3 | 1 | 2 | 3 | 4 | 5 |
| Polybutadiene (1) | | | | | | | 50 | |
| Polybutadiene (2) | 100 | 100 | 100 | 100 | 85 | 100 | 50 | 100 |
| polyisoprene | | | | | 15 | | | |
| Zinc acrylate | 36.8 | 35.3 | 33.8 | 36.8 | 33.8 | 35.3 | 23.5 | 36.8 |
| Peroxide (1) | 0 | 0 | 0 | 0 | 0 | 0 | 0.6 | 0 |
| Peroxide (2) | 3 | 3 | 3 | 3 | 3 | 3 | 0.6 | 3 |
| Sulfur "A" | 0.1 | 0.1 | 0.1 | 0.1 | 0.1 | 0.1 | 0 | 0.1 |
| Antioxidant | 0 | 0 | 0 | 0 | 0 | 0 | 0.1 | 0 |
| Zinc oxide | 24.6 | 25.2 | 25.7 | 29.5 | 34.0 | 25.2 | 28.4 | 24.6 |
| Zinc salt of pentachlorothiophenol "B" | 1.5 | 1.5 | 1.5 | 1.5 | 1.5 | 1.5 | 0.1 | 1.5 |
| "B" (organic sulfur compound)/ "A" (Ratio) | 15 | 15 | 15 | 15 | 15 | 15 | — | 15 |

Polybutadiene (1): Trade name "BR01" by JSR Corporation
Polybutadiene (2): Trade name "BR730" by JSR Corporation
Polyisoprene: "IR2200" from JSR Corporation
Peroxide (1): Dicumyl peroxide, trade name "Percumyl D" by NOF Corporation
Peroxide (2): 1,1-bis(t-butylperoxy)-3,3,5-trimethylcyclo-hexane, trade name "Perhexa 3M-40" by NOF Corporation
Sulfur: "Z Sulfur" by Tsurumi Chemical Industry Corporation (A mixture of 95% Sulfur & 5% Zinc Oxide).
Antioxidant: "Nocrac NS-6" by OuchiShinko Chemical Industrial Co., Ltd.

TABLE 2

| | Composition (pbw) | | | | |
|---|---|---|---|---|---|
| | A | B | C | D | E |
| AM7331 | 85 | | | | |
| Surlyn 8120 | | | | | 35 |
| AM7311 | | 15 | | | |
| AM7317 | | | 50 | | |
| AM7318 | | | 50 | | |
| Himilan 1557 | | 35 | | | |
| Himilan 1605 | | 35 | | | |
| Himilan 1855 | | 15 | | | 35 |
| AN4318 | | | | | 30 |
| Hytrel 3046 | | | | 100 | |
| Dynaron E6100P | 15 | | | | |
| Behenic acid | 20 | | | | |
| Calcium hydroxide | 2.9 | | | | |
| Titanium oxide | | 2.7 | 5 | | 5 |
| MFR (g/10 min) | 3.3 | 2.8 | 1.7 | 10 | 5 |

It is noted that "MFR" in the above Table were the melt flow rate of the composition measured according to JIS K6760 at a temperature of 190° C. and a load of 21.18 N (2.16 kgf).

Surlyn 8120: Ionomer resins by E.I. Du Pont de Nemours & Company.

AM7331: Ionomer resins by Du pont-Mitsui Polychemicals Co., Ltd.

AM7311, 7317, 7318: Ionomer resins by Du pont-Mitsui Polychemicals Co., Ltd.; 7311 is magnesium-neutralized ionomer, 7317 is zinc-neutralized ionomer with an acid content of 18%, 7318 is sodium-neutralized ionomer with an acid content of 18%

Himilan 1557, 1605, 1855: ionomer resins by Du Pont-Mitsui Polychemicals Co., Ltd.

AN4318: "Nucrel" by Du Pont-Mitsui Polychemicals Co., Ltd.

Hytrel 3046: Polyester elastomer by Du pont-Toray Co., Ltd.

Dynaron E6100P: Hydrogenated polymer by JSR Corporation

Behenic acid: "NAA222-S" in bead form, by NOF Corporation

Calcium hydroxide: "CLS-B" by Shiraishi Kogyo Kaisha, Ltd.

TABLE 3

| | | Example | | | Comparative Example | | | | |
|---|---|---|---|---|---|---|---|---|---|
| | | 1 | 2 | 3 | 1 | 2 | 3 | 4 | 5 |
| Core | Outer diameter (mm) | 37.7 | 37.7 | 37.7 | 36.3 | 37.7 | 37.7 | 37.8 | 37.7 |
| | Weight (g) | 33.7 | 33.8 | 33.9 | 31.0 | 33.6 | 33.0 | 34.0 | 33.7 |
| | Deflection amount (mm) | 3.5 | 3.6 | 3.7 | 3.5 | 3.7 | 3.6 | 3.9 | 3.5 |
| | Initial velocity (m/s) | 77.8 | 77.8 | 77.8 | 77.8 | 77.3 | 77.8 | 77.8 | 77.8 |
| | Surface hardness (Shore D) | 57.5 | 55.5 | 55.1 | 57.5 | 55.1 | 55.5 | 50.3 | 57.5 |
| | Center hardness (Shore D) | 37.7 | 37.0 | 36.5 | 37.7 | 36.5 | 37.0 | 39.0 | 37.7 |
| | Difference between surface hardness and center hardness (Shore D) | 19.8 | 18.5 | 18.6 | 19.8 | 18.6 | 18.5 | 11.3 | 19.8 |
| Intermediate layer | Material | A | A | A | A | C | D | A | A |
| | Specific gravity (g/cm$^3$) | 0.94 | 0.94 | 0.94 | 0.94 | 0.98 | 1.07 | 0.94 | 0.94 |
| | Sheet hardness (Shore D) | 51 | 51 | 51 | 51 | 65 | 30 | 51 | 51 |
| | Thickness (mm) | 1.27 | 1.26 | 1.25 | 1.6 | 1.25 | 1.26 | 1.23 | 1.25 |

TABLE 3-continued

| | | Example | | | Comparative Example | | | | |
|---|---|---|---|---|---|---|---|---|---|
| | | 1 | 2 | 3 | 1 | 2 | 3 | 4 | 5 |
| Sphere (core enclosed with intermediate layer) | Outer diameter (mm) | 40.2 | 40.2 | 40.2 | 39.5 | 40.2 | 40.2 | 40.2 | 40.2 |
| | Weight (g) | 39.5 | 39.5 | 39.6 | 37.8 | 39.5 | 39.4 | 39.6 | 39.5 |
| | Deflection amount (mm) | 3.2 | 3.3 | 3.5 | 3.1 | 3.2 | 3.7 | 3.7 | 3.2 |
| Cover | Material | B | B | B | B | B | B | B | E |
| | Specific gravity (g/cm$^3$) | 0.96 | 0.96 | 0.96 | 0.96 | 0.96 | 0.96 | 0.96 | 0.96 |
| | Sheet hardness (Shore D) | 59 | 59 | 59 | 59 | 59 | 59 | 59 | 48 |
| | Thickness (mm) | 1.25 | 1.25 | 1.25 | 1.6 | 1.25 | 1.26 | 1.23 | 1.25 |
| Ball | Outer diameter (mm) | 42.7 | 42.7 | 42.7 | 42.7 | 42.7 | 42.7 | 42.7 | 42.7 |
| | Weight (g) | 45.5 | 45.5 | 45.6 | 45.5 | 45.5 | 45.5 | 45.6 | 45.5 |
| | Deflection amount (mm) | 2.9 | 3.0 | 3.1 | 2.8 | 2.9 | 3.4 | 3.4 | 3.2 |
| | Initial velocity (m/s) | 77.4 | 77.4 | 77.4 | 77.2 | 77.4 | 77.4 | 77.4 | 76.6 |
| Cover hardness - intermediate layer hardness (Shore D) | | 8 | 8 | 8 | 8 | −6 | 29 | 8 | −3 |
| Sphere initial velocity - core initial velocity (m/s) | | 0.5 | 0.4 | 0.5 | 0.6 | −0.1 | 0.4 | 0.4 | 1.2 |
| Sphere deflection amount/core deflection amount | | 0.91 | 0.92 | 0.93 | 0.89 | 0.86 | 1.03 | 0.95 | 0.91 |
| Cover thickness + intermediate layer thickness (mm) | | 2.52 | 2.51 | 2.50 | 3.20 | 2.50 | 2.52 | 2.46 | 2.50 |
| Ball deflection amount/sphere deflection amount | | 0.92 | 0.90 | 0.90 | 0.90 | 0.91 | 0.92 | 0.91 | 1.00 |
| Flight performance, W#1, HS 47 m/s | Carry (m) | 218.4 | 218.5 | 218.3 | 217.4 | 218.4 | 214.0 | 214.7 | 212.8 |
| | Total (m) | 224.9 | 226.9 | 227.1 | 222.5 | 225.8 | 222.1 | 223.1 | 219.5 |
| | Spin (rpm) | 2866 | 2841 | 2792 | 3001 | 2795 | 2867 | 2743 | 3139 |
| | Flight distance | Good | Good | Good | Poor | Good | Poor | Poor | Poor |
| Feel (W#1) | | Good | Good | Good | Good | Good | Good | Good | Good |
| Feel (putter) | | Good | Good | Good | Good | Poor | Good | Good | Good |
| Crack durability | | Good | Good | Good | Good | Poor | Poor | Good | Good |
| Scuff resistance | | Good | Good | Good | Good | Good | Good | Good | Poor |

Flight Performance

Using a hitting robot equipped with a driver (W#1) club, the golf ball was hit at a head speed (HS) of 47 m/s. The carry, total distance and spin rate were measured. The W#1 club used was TourStage X500 (loft 10°) by Bridgestone Sports Co., Ltd. The flight distance is rated "Good" when the total distance is greater than or equal to 224.0 m, and "Poor" when the total distance is less than 224.0 m.

Feel with W#1 and Putter

A sensory test used a panel of ten amateur golfers with an ability to swing W#1 club at a head speed of 45 to 50 m/s. The ball was rated "Good" when seven or more golfers felt good and "Poor" when only four or less golfers felt good.

Crack Durability

Using a hitting robot equipped with a driver (W#1) club, the golf ball was repetitively hit at a head speed of 45 m/s. The number of strikes when the ball surface started crazing was counted. For each ball, three samples were tested and an average number was computed. It was converted to an index provided that the number of strikes on the ball of Example 2 until crazing was 100. The ball was rated "Good" when the index is equal to or greater than 95, and "Poor" when the index is less than 95.

Scuff Resistance

Using a hitting robot equipped with a non-plated pitching sandwedge, the golf ball was once hit at a head speed of 40 m/s. The ball surface was visually examined. The ball was rated "Good" when the ball could be used again and "Poor" when the ball was no longer used.

Dimple Characteristics

Dimple I is described in detail as follows.

TABLE 4

Figure 2:
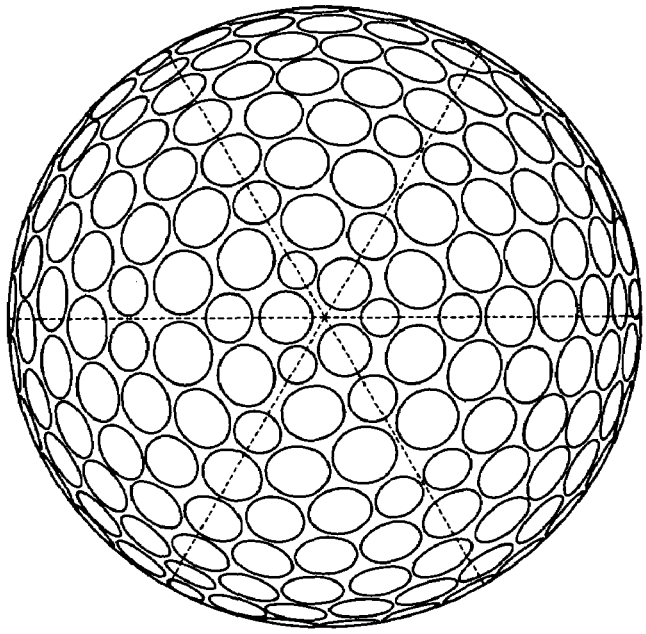
FIG. 2 is a top view of a ball showing the arrangement of dimples used in an embodiment of the invention.

| | No. | Number of dimples | Diameter (mm) | Depth (mm) | $V_0$ | SR (%) | VR (%) | Total dimple volume (mm$^3$) | Dimple arrangement |
|---|---|---|---|---|---|---|---|---|---|
| I | 1 | 12 | 4.573 | 0.138 | 0.481 | 79.8 | 0.757 | 308 | FIG. 2 |
| | 2 | 198 | 4.370 | 0.135 | 0.487 | | | | |
| | 3 | 36 | 3.799 | 0.127 | 0.480 | | | | |
| | 4 | 6 | 3.450 | 0.135 | 0.472 | | | | |
| | 5 | 12 | 2.687 | 0.110 | 0.453 | | | | |
| | 6 | 36 | 4.406 | 0.171 | 0.479 | | | | |
| | 7 | 24 | 3.822 | 0.161 | 0.468 | | | | |
| | 8 | 6 | 3.278 | 0.132 | 0.460 | | | | |
| | Total | 330 | | | | | | | |

Dimple Definitions

Diameter: Diameter of flat plane circumscribed by edge of dimple.

Depth: Maximum depth of dimple from flat plane circumscribed by edge of dimple.

$V_0$: Value obtained by dividing spatial volume of dimple below a flat plane circumscribed by dimple edge by volume of a cylinder whose base is the flat plane and whose height is the maximum depth of dimple from the base.

SR: Ratio of the combined surface area of the dimples on the surface of the golf ball, each dimple surface area being defined by the edge of a flat plane circumscribed by the edge of the dimple, to the total surface area of the ball were the surface of the ball to be free of dimples.

VR: Ratio of the combined volume of the dimples on the surface of the golf ball, each dimple being formed below a flat plane circumscribed by the edge of the dimple, to the volume of the ball were the surface of the ball to be free of dimples.

Aerodynamic Properties (Low-Velocity CL, High-Velocity CD)

The low-velocity CL was determined by calculating the coefficient of lift CL at a Reynolds number of 70,000 and a spin rate of 2,000 from the ball on its trajectory just after it has been launched with an Ultra Ball Launcher (UBL). The high-velocity CD was similarly obtained by measuring the drag coefficient at a Reynolds number of 180,000 and a spin rate of 2,520 rpm just after the ball was hit. The values are as follows.

TABLE 5

| Dimple type | | I |
|---|---|---|
| Aerodynamic properties | Low-velocity CD (70000/2000 rpm) | 0.233 |
| | Low-velocity CL (70000/2000 rpm) | 0.191 |
| | High-velocity CD (180000/2520 rpm) | 0.218 |
| | High-velocity CL (180000/2520 rpm) | 0.166 |

The UBL is a device which includes two pairs of drums, one on top and one on the bottom. The drums are turned by a belt across the two top drums and a belt across the two bottom drums. The UBL inserts a golf ball between the turning drums and launches the golf ball under the desired conditions. This device is manufactured by Automated Design Corporation.

As a result, it is apparent from the results in Table 3 that the golf balls according to Examples 1-3 of the invention have a sufficiently large distance of travel to be advantageous in competitive play, and moreover have a good feel when hit, an excellent durability to cracking with repeated impact and an excellent scuff resistance.

By contrast, sample balls in Comparative Example 1 are poor in flying distance because of the excessively thick total of intermediate layer and cover which result in low rebound resilience and excessive spin. Sample balls in Comparative Example 2 are poor in crack durability when repeated hitting and a feel when hit with a putter because (Deflection amount of the sphere)/(Deflection amount of the core) is less than 0.87 and the intermediate layer is harder than the cover.

Sample balls in Comparative Example 3 are poor in flying distance because of excessive spin at the time of hitting with a W#l club and crack durability when repeated hitting because (Deflection amount of the sphere)/(Deflection amount of the core) is over 0.97.

Sample balls in Comparative Example 4 are poor in flying distance because of insufficient low spin effects because the surface Shore D hardness minus center Shore D hardness in the core is less than 15.

Sample balls in Comparative Example 5 are poor in flying distance because of the excessively soft cover which results in low rebound resilience.

The invention claimed is:

1. A multi-piece solid golf ball, comprising a core, an intermediate layer enclosing the core to form a sphere, and a cover enclosing the intermediate layer, and numerous dimples formed on a surface of the cover, wherein each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (4), (11) & (12):

(1) (Shore D hardness of the cover)—(Shore D hardness of the intermediate layer)>0, (2A) (initial velocity of the core)—(initial velocity of the ball)≧0, (3) 0.87 (Deflection amount of the sphere)/(Deflection amount of the core)≦0.97, (4) the total of the thickness of the intermediate layer and the thickness of the cover is up to 3.0 mm,

(11) (Deflection amount of the golf ball)/(Deflection amount of the sphere)≦0.98, and

(12) (Shore D hardness of core surface)—(Shore D hardness of core center)≧15, wherein the total number of the dimples is at least 280 and not more than 360, the ball has a coefficient of lift (CL) when hit of at least 0.165 at a Reynolds number of 70,000 and a spin rate of 2,000 rpm, and a coefficient of drag (CD) when hit of not more than 0.230 at a Reynolds number of 180,000 and a spin rate of 2,520 rpm.

2. The multi-piece solid golf ball of claim 1, wherein the core comprises a base rubber in which sulfur is compounded in an amount of 0.05 to 0.5 part by weight, and an organosulfur compound is compounded in an amount of 0.05 to 5 parts by weight, per 100 parts by weight of the base rubber, and the amount of sulfur and organosulfur compound in the core satisfies the following requirement:

1≦(amount of the organosulfur compound)/(amount of the sulfur)≧30.

3. The multi-piece solid golf ball of claim 1 which further satisfies the following requirements (5) to (9):

(5) the thickness of the cover is from 0.5 mm to 2.0 mm, (6) the Shore D hardness of the cover is from 52 to 62, (7) the thickness ofthe intermediate layer is from 0.5 mm to 1.6 mm, (8) the Shore D hardness of the intermediate layer is from 40 to 60, and (9) the golf ball has an initial velocity of at least 76.5 m/s.

4. The multi-piece solid golf ball of claim 1, which further satisfies the following requirement (10):

(10) the cover has a melt flow rate (MFR) of at least 2 g/10 mm.

5. The multi-piece solid golf ball of claim 1 wherein the value as described in the requirement (11) is at least 0.85 and not more than 0.95.

6. The golf ball of claim 1 wherein said intermediate layer comprises (A) an ionomer resin comprising (a-1) an olefinlunsaturated carboxylic acid binary random copolymer and/or a metal ion neutralized product thereof and (a-2) an olefinlunsaturated carboxylic acid/unsaturated carboxylic acid ester ternary random copolymer and/or a metal ion neutralized product thereof in a weight ratio (a-1)/(a-2) between 100/0 and 0/100, and (B) a non-lonomeric thermoplastic elastomer in a weight ratio A/B between 100/0 and 50/50.

7. A multi-piece solid golf ball, comprising a core, an intermediate layer enclosing the core to form a sphere, and a cover enclosing the intermediate layer, and numerous dimples formed on a surface of the cover, wherein each component has a Shore D hardness, a Deflection amount, an initial velocity (in m/s) and a thickness (in mm), the Deflection amount being defined as an amount of deflection (in mm) under load of a spherical body incurred when the load is increased from an initial value of 98 N (10 kgf) to a final value of 1275 N (130 kgf), and the ball satisfies the following requirements (1) to (4), (11) & (12):

(1) (Shore D hardness of the cover)—(Shore D hardness of the intermediate layer)>0, (2A) (initial velocity of the core)—(initial velocity of the ball)≧0, (3) 0.87≦(Deflection amount of the sphere)/(Deflection amount of the core)≦0.97, (4) the total of the thickness of the intermediate layer and the thickness of the cover is up to 3.0 mm,

(11) (Deflection amount of the golf ball)/(Deflection amount of the sphere)≦0.98, and

(12) (Shore D hardness of core surface)—(Shore D hardness of core center)≧15, wherein said intermediate layer comprises (A) an ionomer resin comprising (a-1) an olefinlunsaturated carboxylic acid binary random copolymer and/or a metal ion neutralized product thereof and (a-2) an o lefin/unsaturated carboxylic acid/unsaturated carboxylic acid ester ternary random copolymer and/or a metal ion neutralized product thereof in a weight ratio (a-1)/(a-2) between 100/0 and 0/100, and (B) a non-ionomeric thermoplastic elastomer in a weight ratio A/B between 100/0 and 50/50, and wherein said intermediate layer is made of a mixture comprising 100 parts by weight of a resin component comprising the ionomer resin (A) and the non-ionomeric thermoplastic elastomer (B) in a weight ratio A/B between 100/0 and 50/50, (C) 5 to 80 parts by weight of an organic fatty acid and/or a derivative thereof having a molecular weight of 280 to 1,500, and (D) 0.1 to 10 parts by weight of a basic inorganic metal compound capable of neutralizing un-neutralized acid groups in said resin component and component (C).

8. The multi-piece solid golf ball of claim 7, wherein the core comprises a base rubber in which sulfur is compounded in an amount of 0.05 to 0.5 part by weight, and an organosulfur compound is compounded in an amount of 0.05 to 5 parts by weight, per 100 parts by weight of the base rubber, and the amount of sulfur and organosulfur compound in the core satisfies the following requirement:

1≦(amount of the organosulfur compound)/(amount of the sulfur)≦30.

9. The multi-piece solid golf ball of claim 7, which further satisfies the following requirements (5) to (9):

(5) the thickness of the cover is from 0.5 mm to 2.0 mm, (6) the Shore D hardness of the cover is from 52 to 62, (7) the thickness ofthe intermediate layer is from 0.5 mm to 1.6 mm, (8) the Shore D hardness of the intermediate layer is from 40 to 60, and (9) the golf ball has an initial velocity of at least 76.5 m/s.

10. The multi-piece solid golf ball of claim 7, which further satisfies the following requirement (10):

(10) the cover has a melt flow rate (MFR) of at least 2 g/10 min.

11. The multi-piece solid golf ball of claim 7, wherein the value as described in the requirement (11) is at least 0.85 and not more than 0.95.

* * * * *